US008385802B2

(12) United States Patent
Okabe et al.

(10) Patent No.: US 8,385,802 B2
(45) Date of Patent: Feb. 26, 2013

(54) FIXING DEVICE AND IMAGE FORMING APPARATUS

(75) Inventors: Norikazu Okabe, Toyokawa (JP); Hideaki Hayashi, Toyokawa (JP); Satoru Yoneda, Toyohashi (JP); Naoki Yamamoto, Toyohashi (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 307 days.

(21) Appl. No.: 12/781,029

(22) Filed: May 17, 2010

(65) Prior Publication Data

US 2010/0290823 A1 Nov. 18, 2010

(30) Foreign Application Priority Data

May 18, 2009 (JP) ..... 2009-119839

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 7,493,074 | B2 * | 2/2009 | Komuro | 399/328 |
| 7,986,908 | B2 * | 7/2011 | Takada | 399/329 |
| 2008/0181687 | A1 * | 7/2008 | Ishino | 399/329 |

FOREIGN PATENT DOCUMENTS

JP 2005-331576 A 12/2005

* cited by examiner

*Primary Examiner* — David Gray
*Assistant Examiner* — Gregory H Curran
(74) *Attorney, Agent, or Firm* — Buchanan Ingersoll & Rooney PC

(57) ABSTRACT

A fixing device for fixing an unfixed image on a recording sheet passing through a fixing nip formed by pressing a pressing member against an inside surface of a pressure belt via a low friction sheet, so that an outside surface of the pressure belt presses against a fixing member, wherein the pressing member includes a first pressing part having an elastic front face, and (ii) a second pressing part whose front face presses against a rear face of the first pressing part, the low friction sheet extends from a portion thereof pressed by the front face against the pressure belt, to an upstream end thereof, along a lateral side of the first pressing part, the upstream end being upstream from the other end with respect to a rotation direction of the pressure belt and sandwiched between the rear face and the front face by pressure.

14 Claims, 12 Drawing Sheets

FIXING DEVICE AND IMAGE FORMING APPARATUS

This application is based on an application No. 2009-119839 filed in Japan, the contents of which are hereby incorporated by reference.

BACKGROUND OF THE INVENTION (1) Field of the Invention

The present invention relates to a fixing device for fixing an unfixed image formed on a recording sheet by applying heat and pressure while the recording sheet is passing through the fixing nip, the fixing nip being formed between a rotative fixing member, such as a fixing roller, and a pressure belt, pressed against each other. The present invention also relates to an image forming apparatus having the fixing device.

(2) Description of the Related Art

Image forming apparatuses such as photocopying machines are equipped with a fixing device for fixing an unfixed image formed on a recording sheet, such as a sheet of recording paper and an OHP sheet, by applying heat and pressure. Literature 1 (Japanese Patent Application Publication No. 2005-331576) discloses a belt nip type fixing device in which a fixing nip is formed between a roller and a belt. FIGS. 10-14 are schematic views illustrating the technology relating to the Literature 1. FIG. 10 is a schematic cross-sectional view illustrating the structure of the fixing device disclosed in the Literature 1.

In this fixing device, a fixing nip N is formed by pressing a fixing belt 62 against the surface of the heat roll 61, which is provided in parallel with the heat roll 61, toward the axis of the heat roll 61. The heat roll 61 rotates with the surface heated to a predetermined temperature. A pressure pad 63 for pressing the fixing belt 62 against the heat roll 61 is provided inside the area that the fixing belt 62 rotates around. The fixing belt 62 is pressed by the pressure pad 63 against the heat roll 61 which is driven to rotate, and accordingly the fixing belt 62 rotates as the heat roll 61 does. A heater 67 is provided along the axis of the heat roll 61.

The pressure pad 63 is attached to a supporting frame 65 via an elastic sheet 66. The supporting frame 65 is provided inside the area that the fixing belt 62 rotates around, and is biased toward the heat roll 61. By the biasing force (pressing force) applied to the supporting frame 65, the pressure pad 63 presses against the inside surface of the fixing belt 62, along the width direction of the fixing belt 62 (i.e. the axis direction of the heat roll 61).

A low friction sheet 64 for reducing the sliding friction between the pressure pad 63 and the fixing belt 62 is provided between them. Although FIG. 10 depicts the low friction sheet 64 and the fixing belt 62 as though they are away from each other and the pressure pad 63 does not press against the low friction sheet 64, this is for clearly showing the structures of the low friction sheet 64, the fixing belt 62 and the pressure pad 63. In reality, in a fixing device that has been built up, the low friction sheet 64 is pressed by the pressure pad 63 against the inside surface of the rotating fixing belt 62 such that the low friction sheet 64 slides on the inside surface of the rotating fixing belt 62.

The pressure pad 63 includes an elastic pressing part 63*a* and a rigid pressing part 63*b*. To the rigid pressing part 63*b*, the biasing force of the supporting frame 65 is applied via the elastic sheet 66. The elastic pressing part 63*a* is supported by the rigid pressing part 63*b* so as to press the inside surface of the fixing belt 62 via the low friction sheet 64. The elastic pressing part 63*a* consists of an elastic body. The rigid pressing part 63*b* is made from a rigid material that is harder than the elastic pressing part 63*a*.

FIG. 11 is a cross-sectional view showing the structure of the pressure pad 63, and FIG. 12 is a perspective view of the same. By the biasing force (pressing force), which is applied to the rigid pressing part 63*b* and transmitted to the elastic pressing part 63*a*, the elastic pressing part 63*a* is pressed against the inside surface of the fixing belt 62 via the low friction sheet 64. The rigid pressing part 63*b* has a presser 63*c*, which is disposed downstream in the rotation direction of the fixing belt 62. The presser 63*c*, provided along the elastic pressing part 63*a*, projects toward the heat roll 61. The edge of this projection of the presser 63*c* presses against the inside surface of the fixing belt 62 via the low friction sheet 64.

The low friction sheet 64, which is pressed against the fixing belt 62 by the pressure pad 63, is configured to have a rectangular shape. The low friction sheet 64 is disposed along the width direction of the fixing belt 62 such that the downstream end of the low friction sheet 64, which is downstream from the other end in the rotation direction of the fixing belt 62, is positioned downstream from the presser 63*c* of the rigid pressing part 63*b*. The width of the low friction sheet 64 is almost the same as the width of the fixing belt 62.

The low friction sheet 64 extending from its downstream end passes between the pressure pad 63 and the fixing belt 62, and bends away from the inside surface of the fixing belt 62 along the upstream lateral side of the pressure pad 63 with respect to the rotation direction of the fixing belt 62. The upstream end, 64*b*, of the low friction sheet 64 is inserted between the rigid pressing part 63*b* and the elastic sheet 66.

FIG. 13A is a front view of the upstream lateral side of the pressure pad 63. FIG. 13B is a developed view of the upstream end 64*b* of the low friction sheet 64. The face (i.e. rear face) of the rigid pressing part 63*b* that faces the elastic sheet 66 is provided with a plurality of locking parts 63*d* that project toward the elastic sheet 66. The locking parts 63*d* are arranged with predetermined gaps, along the width direction of the fixing belt 62. The upstream end 64*b* of the low friction sheet 64, which is inserted between the rigid pressing part 63*b* and the elastic sheet 66, is provided with a plurality of locking holes 64*a* that correspond to the locking parts 63*d* of the rigid pressing part 63. The locking parts 63*d* are to be inserted into the locking holes 64*a* in one-to-one correspondence.

As the locking parts 63*d* are inserted into the locking holes 64*a*, the upstream end 64*b* of the low friction sheet 64 is fixed to the rigid pressing part 63*b*. The low friction sheet 64, extending from the upstream end 64*b*, is pulled out along the lateral side of the rigid pressing part 63*b*, and is bent to pass between the pressure pad 63 and the fixing belt 62.

In the fixing device having such a structure, the pressure pad 63 presses against the inside surface of the fixing belt 62 via the low friction sheet 64, and therefore the low friction sheet 64 slides on the inside surface of the fixing belt 62 while being pulled downstream by the rotating fixing belt 62. The low friction sheet 64 is made of a material that does not produce a large friction either on the fixing belt 62 or on the pressure pad 63. Thus, the low friction sheet 64 reduces the sliding friction between the fixing belt 62 and the pressure pad 63.

SUMMARY OF THE INVENTION

However, with the above-explained structure for fixing the low friction sheet 64 by inserting the locking parts 63*d* of the rigid pressing part 63*b* into the locking holes 64*a* of the low friction sheet 64, there is a problem that it is impossible to realize long-term stability of the low friction sheet 64.

FIG. 14 is a schematic view showing the upstream end 64*b* of the low friction sheet 64 attached to the pressure pad 63, viewed from the bottom. This drawing illustrates the pulling force to be applied to the upstream end 64*b* while the fixing belt 62 rotates. Due to the rotation of the fixing belt 62, the upstream end 64*b* is pulled downstream in the rotation direction by a pulling force F. As a result, in the upstream end 64*b* of the low friction sheet 64 attached to the pressure pad 63, each of the locking parts 63*d* contacts the opposite end of the corresponding locking hole 64*a* to the pulling direction. Thus, stress is intensively applied to the opposite end. In particular, if the locking parts 63*d* have an angular shape, the stress concentrates on the angle.

In the upstream end 64*b* of the low friction sheet 64, if stress is intensively applied by the locking parts 63*d* arranged with the predetermined gaps along the width direction of the fixing belt 62, there is a risk that the stressed parts of the locking holes 64*a* will be damaged. Also, because of the intensive stress applied by the locking parts 63*d*, a wrinkle 64*d* might be made on the low friction sheet 64 between adjacent two of the locking holes 64*a*, where the stress is relieved.

If the wrinkle 64*d* is made on the low friction sheet 64, there is a risk that the low friction sheet 64 can not efficiently reduce the sliding friction between the fixing belt 62 and the pressure pad 63. Also, the wrinkle 64*d* might accelerate wearing away of the low friction sheet 64, or damage the low friction sheet 64. Moreover, the wrinkle 64*d* might cause uneven gloss of the fixed image.

The present invention aims to solve the problems described above. For this purpose, the present invention provides a fixing device and an image forming apparatus that are capable of preventing a low friction sheet from being damaged, and preventing wrinkles from being made on the low friction sheet, and thereby realizing long-term stability of the low friction sheet.

To fulfill the aim, one aspect of the present invention is a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, and the upstream end is sandwiched between the rear face of the first pressing part and the front face of the second pressing part, by pressure from the second pressing part and a reaction force from the first pressing part.

Another aspect of the present invention is an image forming apparatus having a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, and the upstream end is sandwiched between the rear face of the first pressing part and the front face of the second pressing part, by pressure from the second pressing part and a reaction force from the first pressing part.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

Structure of Image Forming Apparatus

Figure 1:
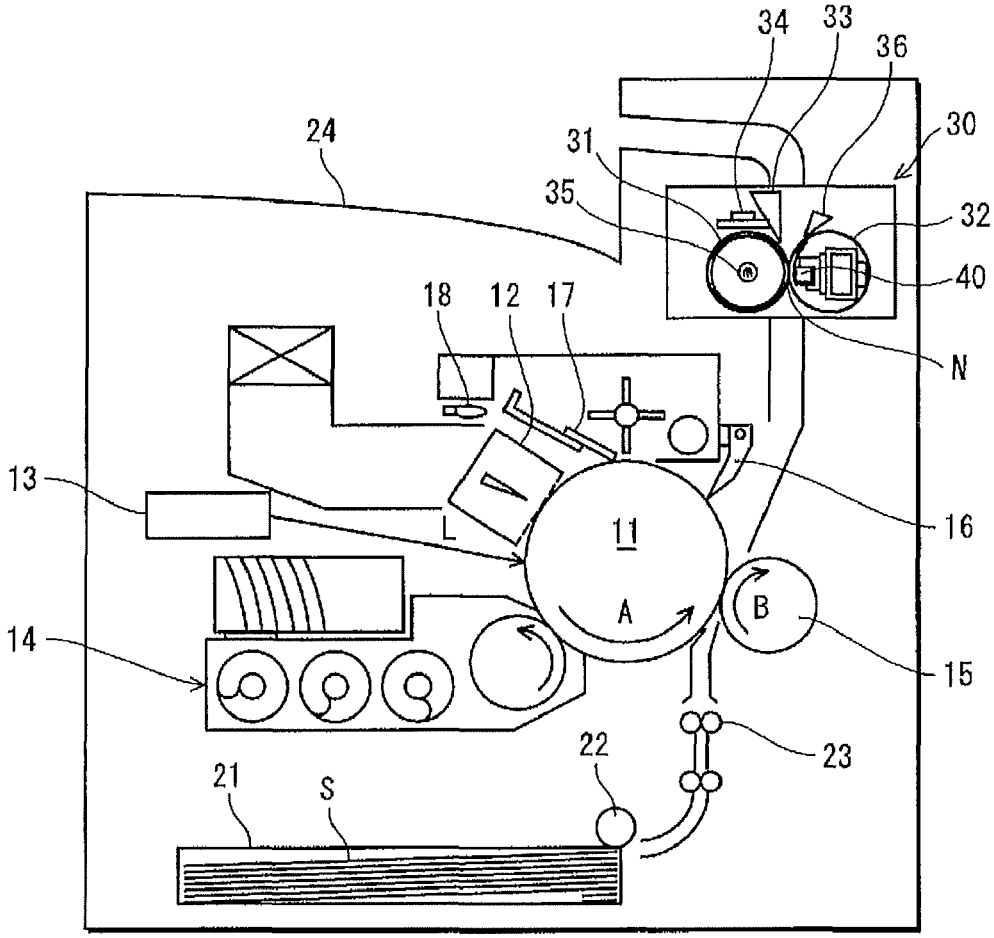
FIG. 1 is a schematic view showing the structure of a printer as an example of an image forming apparatus having an fixing device pertaining to an embodiment of the present invention.

FIG. 1 is a schematic view showing the structure of a printer as an example of an image forming apparatus having a fixing device pertaining to an embodiment of the present invention. This printer forms a monochrome toner image on a recording sheet, such as a sheet of recording paper and an OHP sheet.

The printer shown in FIG. 1 includes a photoreceptor drum 11 which is to be driven to rotate in the direction indicated by the arrow A. A photoreceptor drum 11, a charger 12, an exposure part 13, a developer 14 and a transfer roller 15 are disposed surrounding the photoreceptor drum 11.

In this printer, a controller, which is not shown in the drawing, converts image data received from an external apparatus to a driving signal for a laser diode. The driving signal drives the laser diode, which is provided in the exposure part 13. Thus, the exposure part 13 emits a laser beam L in accordance with the image data. The surface of the photoreceptor drum 11 is beforehand uniformly charged by the charger 12 to have a predetermined electrical potential. As a result of the exposure by the laser beam L emitted from the exposure part 13, an electrostatic latent image is formed on the surface of the photoreceptor drum 11. The developer 14 develops the electrostatic latent image by using toner, to make the image visible as a toner image.

A recording sheet cassette 21 for housing recording sheets S, such as sheets of recording paper and OHP sheets, are provided below the photoreceptor drum 11. A paper feed roller 22 takes out the recording sheets S one by one from the recording sheet cassette 21. Each recording sheet S taken out from the recording sheet cassette 21 is conveyed to the photoreceptor drum 11 by a timing roller 23 with a predetermined timing.

A transfer roller 15, which rotates in the direction indicated by the arrow B, is provided next to the photoreceptor drum 11. The recording sheet S passes through the transfer nip formed by pressing the transfer roller 15 and the photoreceptor drum 11 against each other. When the recording sheet S passes through the transfer nip, the toner image formed on the photoreceptor drum 11 is transferred onto the recording sheet S by the effect of the transfer field generated by the transfer voltage applied to the transfer roller 15.

The recording sheet S, onto which the toner image has been transferred, is peeled off from the photoreceptor drum 11 by a separation claw 16, and is conveyed to the fixing device 30. The fixing device 30 applies heat and pressure to the unfixed toner image on the recording sheet S to fix it. After that, the recording sheet S with the fixed toner image is discharged on a receiving tray 24.

After the transfer of the toner image, toner remaining on the surface of the photoreceptor drum 11 is cleaned up with a cleaner 17, and remaining charge thereon is erased by an eraser 18. The surface of the photoreceptor drum 11, from which the remaining charge has been erased, is then charged by the charger 12 according to the next instruction for image forming. The operations described above are repeated to form toner images on the recording sheets S.

Structure of Fixing Device

Figure 2:
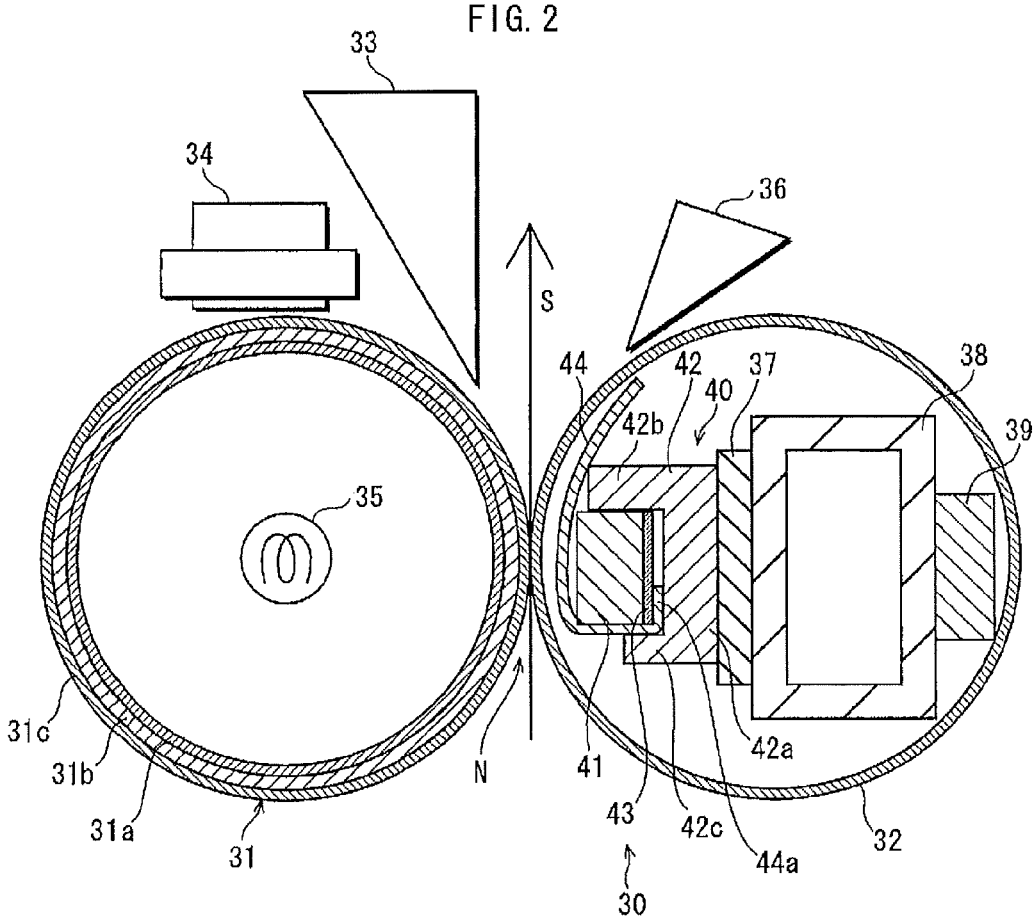
FIG. 2 is a schematic cross-sectional view illustrating the structure of the fixing device provided in the printer.

FIG. 2 is a schematic cross-sectional view showing the main components of the fixing device 30. The fixing device 30 includes a fixing roller 31 as a rotative fixing member, and a pressure belt 32 pressed against the fixing roller 31 by a pressing member 40. The pressure belt 32 is an endless belt, and is pressed by the pressing member 40 against the surface of the fixing roller 31 that is driven to rotate. Thus, the pressure belt 32 rotates according to the rotation of the fixing roller 31. A fixing nip N is formed by pressing the fixing roller 31 and the pressure belt 32 against each other.

The fixing roller 31 has a cylindrical shape. A heater 35 is provided along the axis of the fixing roller 31. The heater 35 is for heating the surface of the fixing roller 31 to a predetermined temperature at which toner is fused. The heater 35 is controlled based on the surface temperature of the fixing roller 31 detected by a thermistor 34.

An unfixed toner image on the recording sheet S conveyed to the fixing device 30 is to be fixed on the recording sheet S by application of heat and pressure while the recording sheet S passes through the fixing nip N. The fixing nip N is formed by pressing the pressure belt 32, which rotates, against the fixing roller 31, which rotates and has the surface heated to the predetermined temperature. The recording sheet S, on which the toner image has been fixed, is peeled off from the fixing roller 31 by separation claws 33 and 36.

For example, the fixing roller 31 has an outside diameter of 10-50 mm, and includes the following: a metal core 31*a* made from a metal pipe having a thickness of 0.1-5.0 mm, such as aluminum and steel; an intermediate layer 31*b* layered on the outside surface of the metal core 31*a*; and a surface layer 31*c* covering the surface of the intermediate layer 31*b*.

It is preferable that the thickness of the metal core 31*a* is 0.2-1.5 mm for example, in view of weight saving and reduction of the warm-up time (i.e. the time from the power-on to when the surface temperature of the fixing roller 31 has been increased to the temperature required for the fixing).

It is preferable that the intermediate layer 31*b*, formed between the metal core 31*a* and the surface layer 31*c* of the fixing roller 31, is made of a material that has elasticity and a high heat resistance, such as silicone rubber and fluororubber. Although the thickness of the intermediate layer may be determined arbitrarily, the thickness is preferably in the range of 0.05-2 mm. The intermediate layer 31*b* is resiliently deformed by the pressure belt 32 pressed against it by the pressing member 40.

To easily release the recording sheet S, the surface layer 31*c* covering the surface of the intermediate layer 31*b* is preferably formed from a fluorine-based tube or a fluorine-based coating, such as PFA, PTFE and ETEE. As a fluorine-based tube, products of Du Pont-Mitsui Fluorochemicals Co., Ltd., such as "PFA350-J", "451HP-J" and "951HP Plus" may be used. The surface layer 31*c* may have electrical conductivity. The thickness of the surface layer 31*c* is preferably in the range of 5-100 μm. The contact angle with water is preferably no less than 90°, and particularly preferable if it is no less than 110°. Surface roughness Ra of the surface layer 31*c* is preferably in the range of 0.01-50 μm.

The pressure belt 32 includes a substrate formed to be endless, from a band plate made of, for example, polyimide, polyphenylene sulfide, nickel, steel, SUS, or the like. To easily release the recording sheet S, the surface of the substrate may be covered with a surface layer formed from a fluorine-based tube or a fluorine-based coating, such as PFA, PTFE and ETEE. The surface layer may have electrical conductivity. The thickness of the surface layer is preferably in the range of 5-100 μm. Although the thickness of the pressure belt 32 is not necessarily limited to any value, it is preferable if the thickness is in the range of 0.05-2 mm. The outside diameter of the pressure belt 32 is preferably in the range of 20-100 mm. Both side-ends of the pressure belt 32 with respect to the width direction thereof are respectively guided by belt-guide members (not illustrated) such that the pressure belt 32 rotates without wobbling.

The pressing member 40, which presses against the inside surface of the pressure belt 32, is a long member extending along the axis direction of the fixing roller 31. The pressing member 40 is provided inside the area that the pressure belt 32 rotates around, so as to face toward the fixing roller 31 via the pressure belt 32 and a low friction sheet 44. The pressing member 40 presses against the inside surface of the pressure belt 32 across the full width of the inside surface, via the low friction sheet 44.

Figure 3:
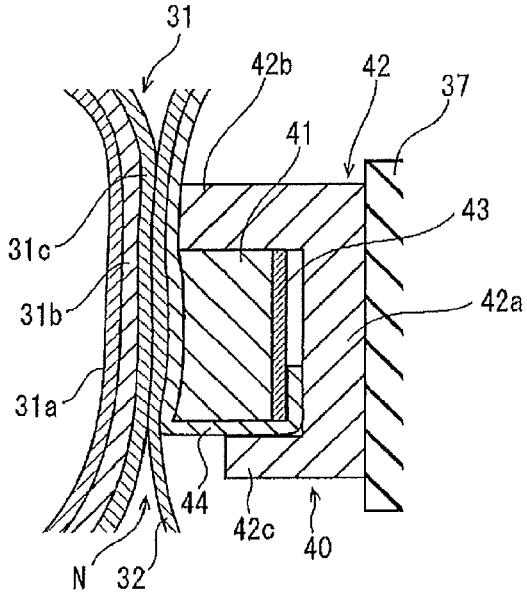
FIG. 3 is a cross-sectional view illustrating actual states of main parts of the fixing device.

In FIG. 2, the low friction sheet 44 is depicted as though it is away from the inside surface of the pressure belt 32 and the pressing member 40 does not presses the low friction sheet 44. However, in the fixing device that has been built up as shown in FIG. 3, the pressing member 40 presses against the pressure belt 32 via the low friction sheet 44, and the pressure belt 32 is pressed against and contacts with the fixing roller 31.

The pressing member 40 is supported by a supporting frame 38 via an elastic sheet 37. The supporting frame 38 is provided inside the area that the pressure belt 32 rotates around. The supporting frame 38 is made from, for example, a drawn metal, an extruded metal, or a sheet metal. The metal is, for example, aluminum or steel. The supporting frame 38 is formed in a tubular shape having a rectangular cross section, for example. The supporting frame 38 extends along the width direction of the pressure belt 32.

Both ends of the supporting frame 38 with respect to the longitudinal direction protrude out of both ends of the pressure belt 32 with respect to the width direction, respectively. Each end of the supporting frame 38 is biased toward the fixing roller 31 by a biasing member such as a spring. One face (i.e., the front face) of the supporting frame 38 faces toward the fixing roller 31. The elastic sheet 37 is provided on the front face, and the pressing member 40 is supported on the elastic sheet 37.

An oil applying member 39 is provided on another face (i.e., the rear face) of the supporting frame 38, which is opposite to the front face on which the elastic sheet 37 is provided. The oil applying member 39 is for applying lubricating oil to the inside surface of the pressure belt 32. The oil applying member 39 is made from, for example, felt impregnated with lubricating oil. The oil applying member 39 slides on the inside surface of the pressure belt 32 that is rotating, so that lubricating oil is applied to the whole inside surface of the pressure belt 32.

Structure of Pressing Member

Figure 4:
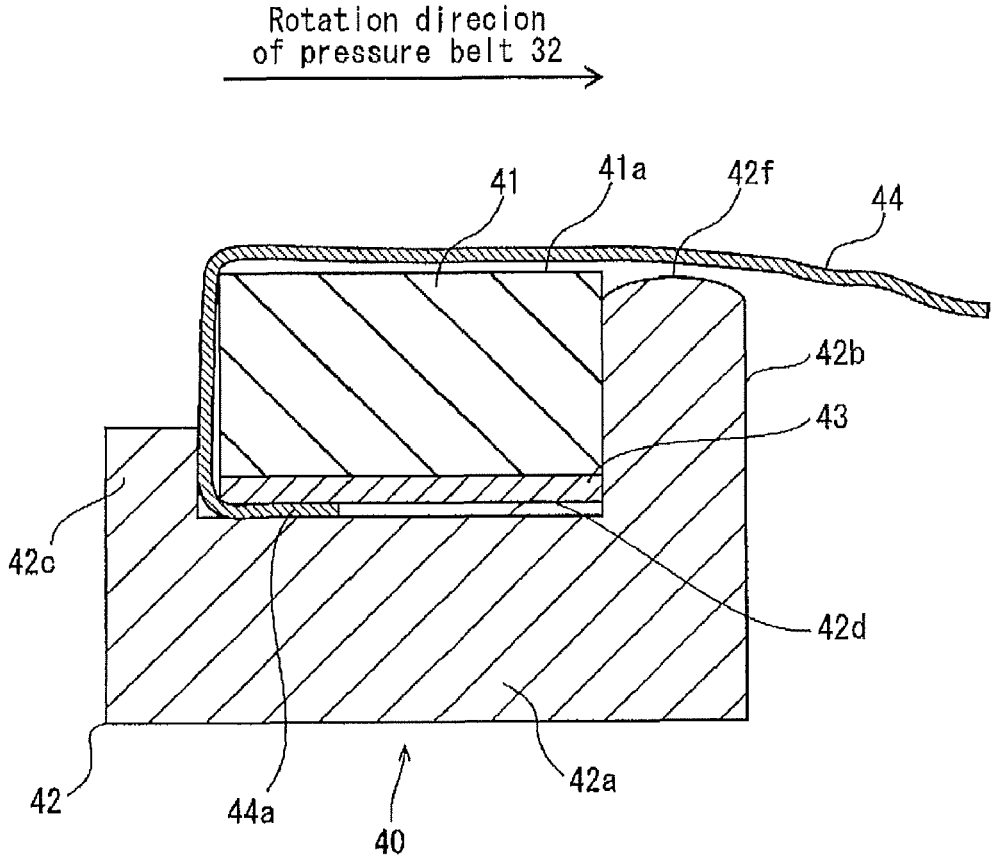
FIG. 4 is a cross-sectional view of a pressing member provided in the fixing device.
Figure 5:
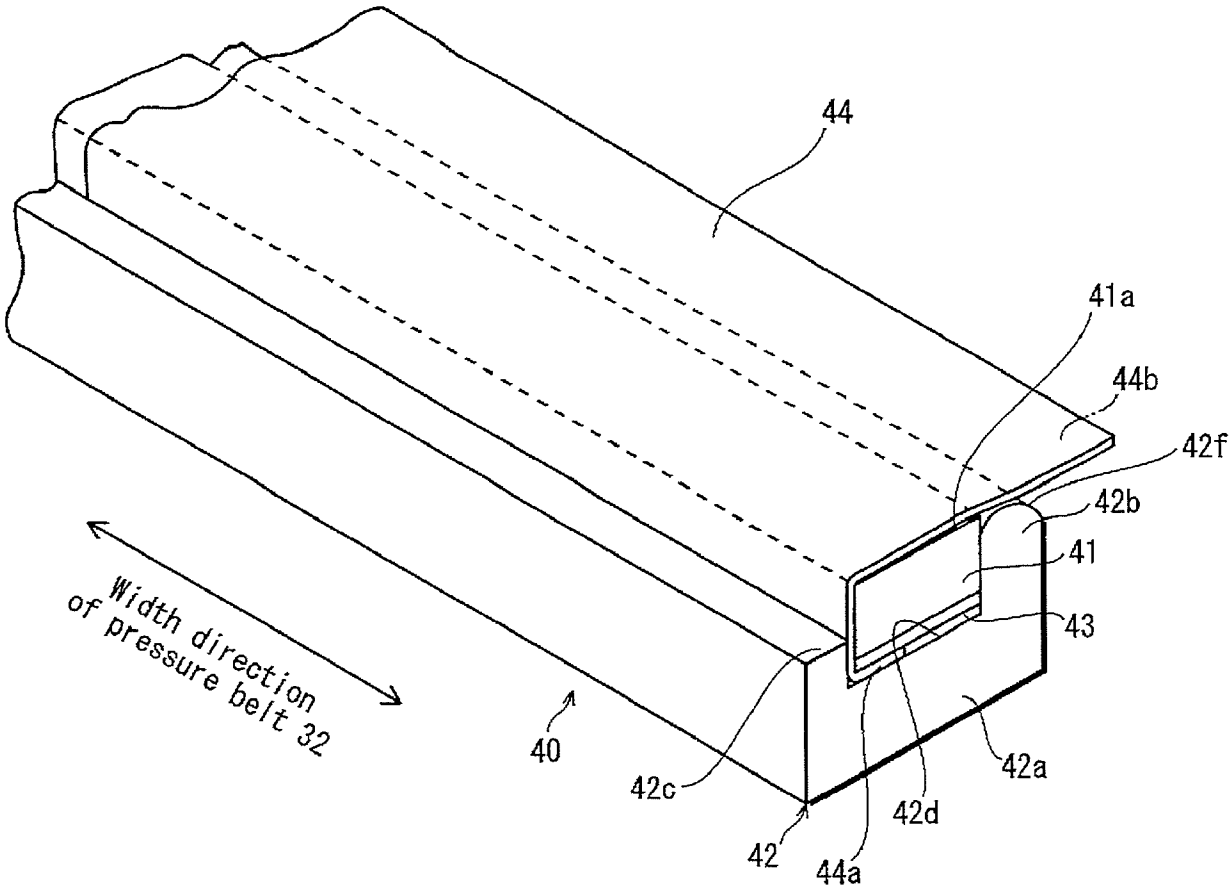
FIG. 5 is a perspective view showing a part of the pressing member.
Figure 6A:
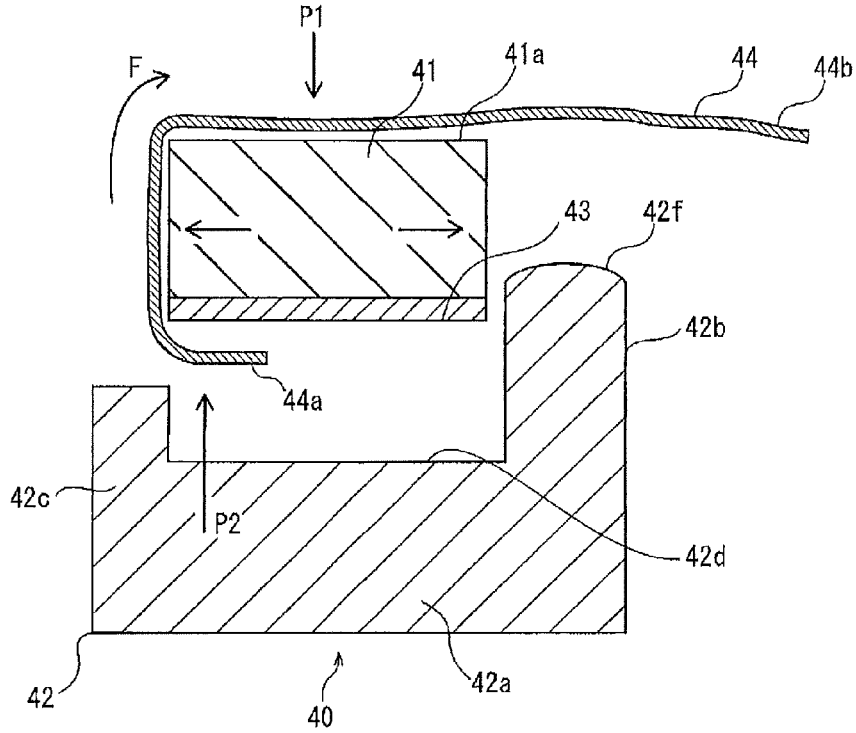
FIG. 6A is an exploded cross-sectional view of the pressing member.

FIG. 4 is a cross-sectional view of the pressing member 40, and FIG. 5 is a perspective view showing a part of the pressing member 40. FIG. 6A is an exploded cross-sectional view of the pressing member 40. Note that each of FIGS. 4 to 6A is depicted such that the upper side of the sheet of the drawing is the side where the fixing roller 31 exists.

Also, each depicts the pressing member 40 in the state of not pressing against the pressure belt 32.

The pressing member 40 includes an elastic pressing part (first pressing part) 41, a rigid pressing part (second pressing part) 42, and a reinforcing part 43. The rigid pressing part 42 is provided on the elastic sheet 37 on the front face of the supporting frame 38. The elastic pressing part 41 is supported by the rigid pressing part 42 such that it faces toward the outside surface of the fixing roller 31 via the low friction sheet 44 and the pressure belt 32. The reinforcing part 43 is in the form of a sheet and is attached to the elastic pressing part 41. The elastic pressing part 41 is made from an elastic material. The rigid pressing part 42 is made from a rigid material that is harder than the elastic pressing part 41.

The rigid pressing part 42 includes a main supporting structure 42*a*, a presser 42*b* and a side wall 42*c*. The main supporting structure 42*a* extends straight along the width direction of the pressure belt 32. The presser 42*b* is provided along the downstream lateral side of the main supporting structure 42*a* with respect to the rotation direction of the fixing roller 31, so as to protrude a predetermined length toward the fixing roller 31. The side wall 42*c* is provided along the upstream lateral side of the main supporting structure 42*a* with respect to the rotation direction of the fixing roller 31, so as to protrude a predetermined length toward the fixing roller 31. The protrusion of the side wall 42*c* is shorter than the protrusion of the presser 42*b* of the main supporting structure 42*a*.

The length (width) of the main supporting structure 42*a* in the direction toward the fixing roller 31 is substantially even along the width direction of the pressure belt 32. Thus, the main supporting structure 42*a* is supported on the elastic sheet 37 such that the biasing force applied to the supporting frame 38 is transmitted evenly toward the fixing roller 31 across the full width of the pressure belt 32. The front face of the main supporting structure 42*a* between the presser 42*b* and the side wall 42*c* is a supporting face 42*d* for supporting the elastic pressing part 41. The supporting face 42*d* is flat across the conveying direction of the sheet S and the width direction of the pressure belt 32.

When not pressing against the pressure belt 32, the elastic pressing part 41 is in the shape of a rectangular parallelepiped that extends along the width direction of the pressure belt 32, across the full width. The reinforcing part 43 in the form of a sheet is attached to the whole rear face of the elastic pressing part 41 that faces toward the main supporting structure 42*a*. Thus, the elastic pressing part 41 extends straight along the width direction of the pressure belt 32.

In some cases, the elastic pressing part 41 can not keep the straight shape, depending on the thickness and the degree of the elasticity. That is, when supported by the rigid pressing part 42, the elastic pressing part 41 can not be kept straight along the width direction of the pressure belt 32. The reinforcing part 43 is provided for reinforcing the elastic pressing part 41 so that the elastic pressing part 41 is kept straight along the width direction of the pressure belt 32. The rigid pressing part 42 is made from a rigid material that is harder than the elastic pressing part 41.

The elastic pressing part 41 fits between the presser 42*b* and the side wall 42*c*, and is supported by the rigid pressing part 42 such that the reinforcing part 43 attached to the elastic pressing part 41 faces the supporting face 42*d* of the main supporting structure 42*a*. The front face of the elastic pressing part 41, which is the opposite face to the face contacting the supporting face 42*d*, is an elastic pressing face 41*a*. The elastic pressing face 41*a* presses against the fixing roller 31 via the low friction sheet 44 and the pressure belt 32.

The elastic pressing face 41*a* of the elastic pressing part 41 is pressed against and contacts with the low fraction sheet 44 due to the pressure applied to the main supporting structure 42*a*. The elastic pressing part 41 presses against the inside surface of the pressure belt 32 via the low friction sheet 44, so that the pressure belt 32 is pressed against and contact with the fixing roller 31. The elastic pressing part 41 presses against the fixing roller 31 via the pressure belt 32 and the low friction sheet 44. Accordingly, the elastic pressing part 41 is resiliently deformed by the reaction force from the fixing roller 31. That is, it yields to the reaction force as shown in FIG. 3.

When the elastic pressing part 41 presses against the fixing roller 31 and yields to the reaction force and is resiliently deformed, a rigid pressing face 42*f*, which is the face of the protrusion of the presser 42*b*, presses against the fixing roller 31 via the low friction sheet 44 and the pressure belt 32. Thus, the surface of the fixing roller 31 yields to the pressure and is resiliently deformed. The pressure belt 32 contacts with the fixing roller 31 along the surface of the fixing roller 31, and the fixing nip N is formed on the contact surfaces.

The main supporting structure 42*a*, the presser 42*b* and the side wall 42*c* of the rigid pressing part 42 is integrally made from resin such as polyphenylene sulfide, polyimide, and liquid crystal polymer and metal such as aluminum and steel, and ceramic.

The elastic pressing part 41 is made from a material that has elasticity and a high heat resistance, such as silicone rubber and fluororubber. The Asker C hardness of the elastic pressing part 41 is preferably in the range of 15° to 30°. The thickness of the elastic pressing part 41 (i.e., the length along the protrusion of the presser 42*b*) is in the range of 2.0 to 10 mm.

The reinforcing part 43 is made from a plate of metal such as aluminum and steel. The thickness of the reinforcing part 43 (i.e., the length along the protrusion of the presser 42*b*) is in the range of 0.1 to 3 mm. The reinforcing part 43 is made by, for example, punching of a metal plate.

The low friction sheet 44 is provided between the pressing member 40 and the inside surface of the pressure belt 32, in order to reduce the sliding friction between the pressure belt 32 and the pressing member 40. The low friction sheet 44 is made from, for example, a glass cloth impregnated with heat-resistant resin. The glass cloth is a base material for the low friction sheet 44. As the heat-resistant resin, fluorine-based resin such as PTFE is usable.

The low friction sheet 44 is formed in a rectangular shape, and placed such that the orthogonal ends of the low friction sheet 44 extend along the width direction and the rotation direction of the pressure belt 32. The length of the low friction sheet 44 along the width direction of the pressure belt 32 is substantially equal to the length of the pressure belt 32 in the width direction. As FIG. 5 shows, a downstream end 44*b* of the low friction sheet 44, which is downstream from the other end in the rotation direction of the pressure belt 32, is positioned downstream from the presser 42*b* of the rigid pressing part 42. The low friction sheet 44 extending from its downstream end passes between the inside surface of the pressure belt 32 and the presser 42*b* of the rigid pressing part 42 and the elastic pressing part 41.

The part of the low friction sheet 44 that is upstream from the part between the inside surface of the pressure belt 32 and the elastic pressing part 41 is bent away from the pressure belt 32, and is extended along the upstream lateral side of the elastic pressing part 41 from the front face to the rear face. The upstream end, 44*a*, of the low friction sheet 44 is inserted between the reinforcing part 43 and the main supporting structure 42*a* of the rigid pressing part 42, and the full width of the upstream end 44*a* is supported between the reinforcing part 43 and the main supporting structure 42*a* along the width direction of the pressure belt 32. The length of the upstream end 44*a*, where is inserted between the reinforcing part 43 and the main supporting structure 42*a*, is, for example, greater than ⅓ of the length of the reinforcing part 43 in the direction of the insertion.

The low friction sheet 44, extending from the upstream end 44*a* sandwiched between the reinforcing part 43 and the main supporting structure 42*a*, is pulled out along the lateral side of the elastic pressing part 41 toward the fixing roller 31, and passes between the inside surface of the pressure belt 32 and the elastic pressing part 41 and between the inside surface of the pressure belt 32 and the presser 42*b* of the rigid pressing part 42. Thus, the low friction sheet 44 slides on the pressure belt 32 while being pressed against the inside surface of the rotating pressure belt 32 by the elastic pressing part 41 and the presser 42*b* of the rigid pressing part 42.

As FIG. 2 and FIG. 3 show, in the fixing device 30 with the stated structure, the pressure belt 32, which is pressed against and contacts with the fixing roller 31, rotates in accordance with the rotation of the fixing roller 31 which is driven to rotate. Under such a condition, the recording sheet S, on which a toner image has been transferred at the transfer nip where the photoreceptor drum 11 and the transfer roller 15 are pressed against each other, goes into the fixing nip N between the fixing roller 31 and the pressure belt 32. Here, regarding the sheet S, the side on which the toner image has been transferred faces the fixing roller 31. The toner image on the recording sheet S is fixed on the recording sheet S while it passes through the fixing nip N, by application of heat and pressure.

After passing through the part where the pressure belt 32 and the fixing roller 31 are pressed against each other by the elastic pressing part 41, the recording sheet S then passes through the part where the pressure belt 32 is pressed against the fixing roller 31 harder by the presser 42*b* of the rigid pressing part 42, and is discharged from the fixing nip N. In the vicinity of the exit of the fixing nip N, the fixing roller 31 is pressed hard by the presser 42*b* of the rigid pressing part 42. Thus, the fixing roller 31 is resiliently deformed in the shape of a small dent with a small radius of curvature. The recording sheet S is readily separated from the fixing roller 31 because it can not follow the rotation of the fixing roller 31 due to the resiliently deformed part with the small radius of curvature. This is called "self stripping".

Lubricating oil is applied to the inside surface of the rotative pressure belt 32 by the oil applying member 39. The lubricating oil penetrates into the interface between the inside surface of the pressure belt 32 and the low friction sheet 44. The surface of the low friction sheet 44 has unevenness of the glass cloth as the basic material. Thus, even when the low friction sheet 44 is pressed against the inside surface of the pressure belt 32, the lubricating oil applied to the inside surface of the pressure belt 32 is not pushed out from the interface between the inside surface of the pressure belt 32 and the low friction sheet 44, and remains in the concavities on the low friction sheet 44. The lubricating oil reduces the sliding friction between the inside surface of the pressure belt 32 and the low friction sheet 44. Thus, the pressure belt 32 rotates smoothly.

As FIG. 3 shows, the pressing member 40 presses against the inside surface of the rotating pressure belt 32, via the low friction sheet 44, so that the pressure belt 32 and the fixing roller 31 are pressed against and contact with each other. As FIG. 6A shows, when the elastic pressing part 41 with the main supporting structure 42*a* presses against the inside surface of the pressure belt 32 via the low friction sheet 44 by a pressing force P1, a reaction force P2 equal to the pressing force P1 is generated from the inside surface of the pressure belt 32. Furthermore, according to the rotation of the pressure belt 32, a pulling force F in the rotation direction is applied to the low friction sheet 44 between the inside surface of the pressure belt 32 and the elastic pressing part 41. Thus, the pulling force F is also applied to the upstream end 44*a* of the low friction sheet 44 between the main supporting structure 42*a* of the rigid pressing part 42 and the reinforcing part 43.

However, the full width of the upstream end 44*a* of the low friction sheet 44 is supported between the main supporting structure 42*a* of the rigid pressing part 42 and the reinforcing part 43 along the width direction of the pressure belt 32, the pressing force P1 and the reaction force P2 are evenly applied to the upstream end 44*a* across the full width, along the width direction of the pressure belt 32. Accordingly, the pulling force F applied to the upstream end 44*a* is substantially evenly distributed across the whole area of the upstream end 44*a*. Thus, the stress due to the pulling force F is not intensively applied to any particular area on the upstream end 44*a*. This prevents the low friction sheet 44 from being damaged, and prevents wrinkles from being made on the low friction sheet 44.

If the pressing force P2 by the elastic pressing part 41 increases, the friction between the pressure belt 32 and the low friction sheet 44 increases, and accordingly the pulling force F applied to the upstream end 44*a* of the low friction sheet 44 increases as well. However, if this is the case, the reaction force P1 from the inside surface of the pressure belt 32 also increases, and the pressure that holds the upstream end 44*a* of the low friction sheet 44 increases accordingly. Thus, even in this case, the upstream end 44*a* of the low friction sheet 44 is continuously and stably supported by the increased pressure. This more surely prevents the stress due to the pulling force F from being intensively applied to any particular area on the upstream end 44*a*, and more sure prevents damages of and wrinkles on the upstream end 44*a*.

Also, the low friction sheet 44 is inserted between the reinforcing part 43 and the main supporting structure 42*a* of the rigid pressing part 42 so as to extend along the lateral face (lateral side) of the elastic pressing part 41. Thus, the length of the low friction sheet 44 along the rotation direction of the pressure belt 32 is shorter and the area of the low friction sheet 44 is smaller than the cases shown in FIGS. 10 to 14, in which the upstream end 64*b* of the low friction sheet 64 is fixed between the rigid pressing part 63*b* and the elastic sheet 66. This reduces the usage amount of the low friction sheet 44, and improves the economic efficiency.

The width of the upstream end 44*a* of the low friction sheet 44, which is sandwiched between the reinforcing part 43 and the main supporting structure 42*a* of the rigid pressing part 42, is not limited to the width of the pressure belt 32. The width may be determined to be within the range that does not cause wrinkles. However, it is preferable that the width of the upstream end 44*a* is at least greater than the width of the recording sheet S passing through the fixing nip N formed by the pressure-contact between the fixing roller 31 and the pressure belt 32. Here, the width of the recording sheet means the length in the width direction of the pressure belt 32.

Also, the length of the upstream end 44*a* of the low friction sheet 44, where is inserted between the reinforcing part 43 and the main supporting structure 42*a* of the rigid pressing part 42, is not limited to any particular length. The length may be determined to be any value as long as the upstream end 44*a* does not readily slips out. Thus, the length of the upstream end 44*a* may be less than ⅓ of the length of the reinforcing part 43.

The width of the low friction sheet 44 is not necessarily equal to the width of the pressure belt 32 along the whole length of the pressure belt 32. That is, the low friction sheet 44 may only partially have the same width as the pressure belt 32. Moreover, the rigid pressing part 42 may not have the side wall 42*c*.

Figure 6B:
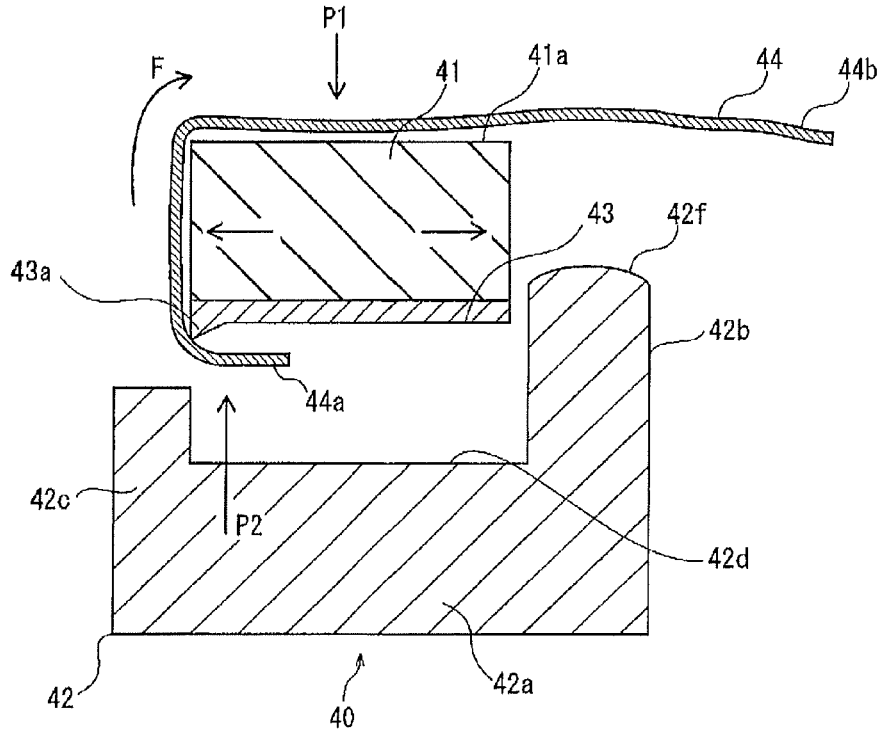
FIG. 6B is an exploded cross-sectional view of a modification example of the pressing member.

Also, as FIG. 6B shows, the reinforcing part 43 may have a protrusion part 43*a*. The protrusion part 43*a* is provided at the upstream end of the reinforcing part 43 with respect to the conveyance direction of the recording sheet, along the width direction of the recording sheet S. The protrusion part 43*a* is provided along the full width of the upstream end so as to protrude toward the main supporting structure 42*a*. The protrusion part 43*a* has, for example, a cross section in the shape of a triangle pointing to the main supporting structure 42*a*. This increases the resisting force against the pulling force applied to the low friction sheet 44, and realizes more stably holding of the upstream end 44*a* of the low friction sheet 44.

In the case of forming the reinforcing part 43 by punching of a metal plate, it is possible to leave burrs generated by the punching, and use the burrs as the protrusion part 43*a*. In other words, burrs may function as the protrusion part 43*a* if they are left in the punching, and the reinforcing part 43 is placed such that the burrs face the supporting face 42*d* of the rigid pressing part 42.

Modification Example 1

Figure 7:
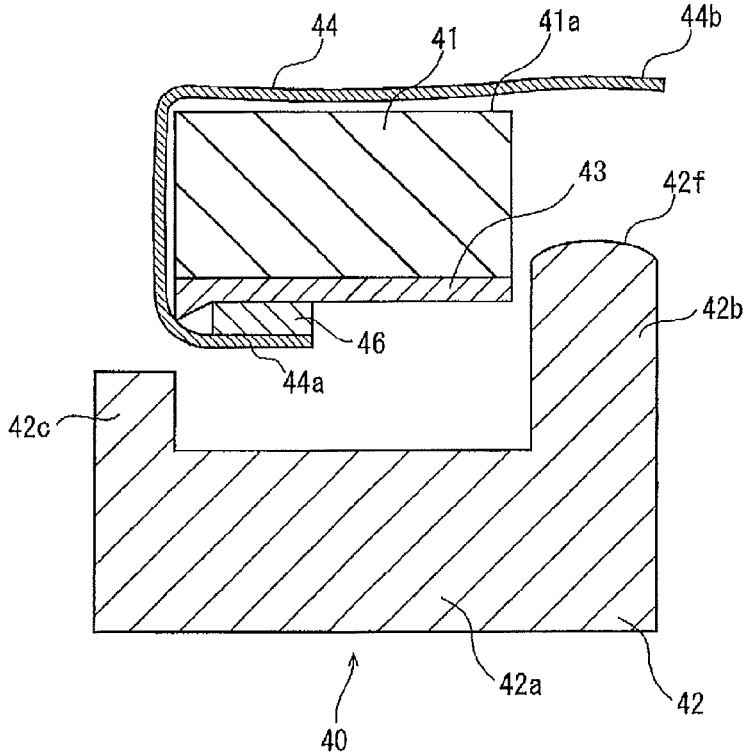
FIG. 7 is an exploded cross-sectional view of another example of the pressing member used in the fixing device pertaining to the embodiment of the present invention.

The structure of the pressing member 40 pertaining to the present invention is not limited to that of the embodiment described above. For example, as FIG. 7 shows, the whole surface of the part of the low friction sheet 44 that is sandwiched between the reinforcing part 43 and the main supporting structure 42*a* of the rigid pressing part 42 may be bonded to the reinforcing part 43 with a bonding member such as a fluorine-resin-based adhesive agent and a double-faced adhesive tape, or by welding.

With such a structure, the upstream end 44*a*, sandwiched between the reinforcing part 43 and the main supporting structure 42*a*, has an increased resisting force against the pulling force applied to the low friction sheet 44, because of the adherence to the reinforcing part 43. This realizes more stably holding of the upstream end 44*a* of the low friction sheet 44, and more surely prevents the upstream end 44*a* from slipping out from between the reinforcing part 43 and the main supporting structure 42*a*. Note that instead of bonding the low friction sheet 44 to the reinforcing part 43, it is possible to realize such an effect in another manner. For example, the low friction sheet 44 may be bonded to the main supporting structure 42*a*, or to both the reinforcing part 43 and the main supporting structure 42*a*.

Modification Example 2

Figure 8:
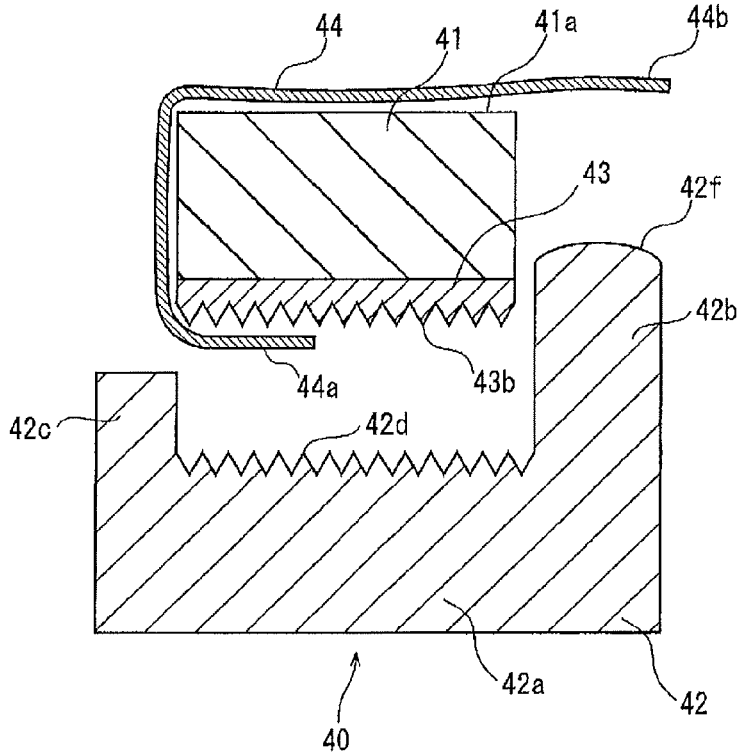
FIG. 8 is an exploded cross-sectional view of yet another example of the pressing member used in the fixing device pertaining to the embodiment of the present invention.

Moreover, as shown in FIG. 8, the reinforcing part 43 may be provided with an uneven surface 43*b* having asperities and facing the main supporting structure 42*a*, and at the same time, the whole supporting face 42*d* may have asperities. The asperities on the supporting face 42*d* can be generated by mechanical polishing, chemical polishing, chemical mechanical polishing, or the like. With such a structure, the upstream end 44*a* has an increased friction resistance against the pulling force applied to the low friction sheet 44. This realizes more stably holding of the upstream end 44*a* of the low friction sheet 44, and more surely prevents the upstream end 44*a* from slipping out from between the reinforcing part 43 and the main supporting structure 42*a*. Note that instead of providing asperities on both the reinforcing part 43 and the main supporting structure 42*a*, it is possible to realize such an effect in another manner. For example, asperities may be provided on either one of the reinforcing part 43 and the main supporting structure 42*a*. Also, asperities are not necessarily provided on the whole surfaces of the reinforcing part 43 and the main supporting structure 42*a*. Asperities may be provided only on the part where the low friction sheet 44 is held.

Modification Example 3

Figure 9:
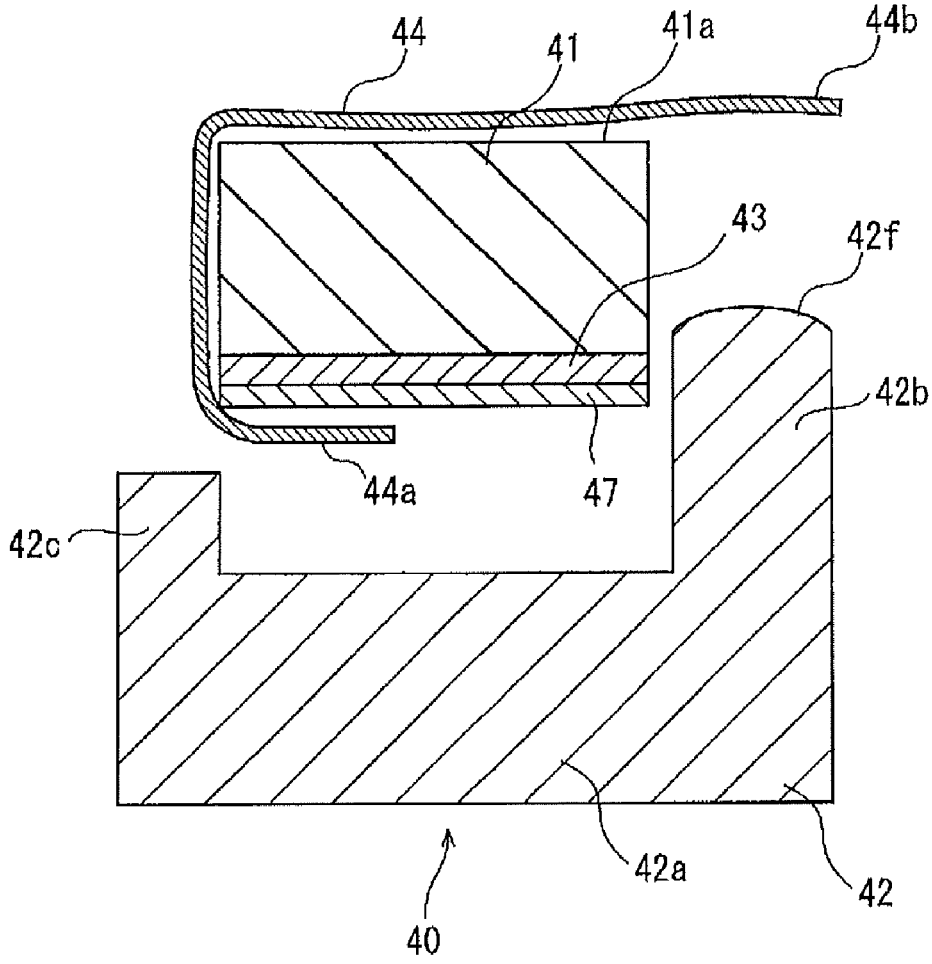
FIG. 9 is an exploded cross-sectional view of yet another example of the pressing member used in the fixing device pertaining to the embodiment of the present invention.
Figure 10:
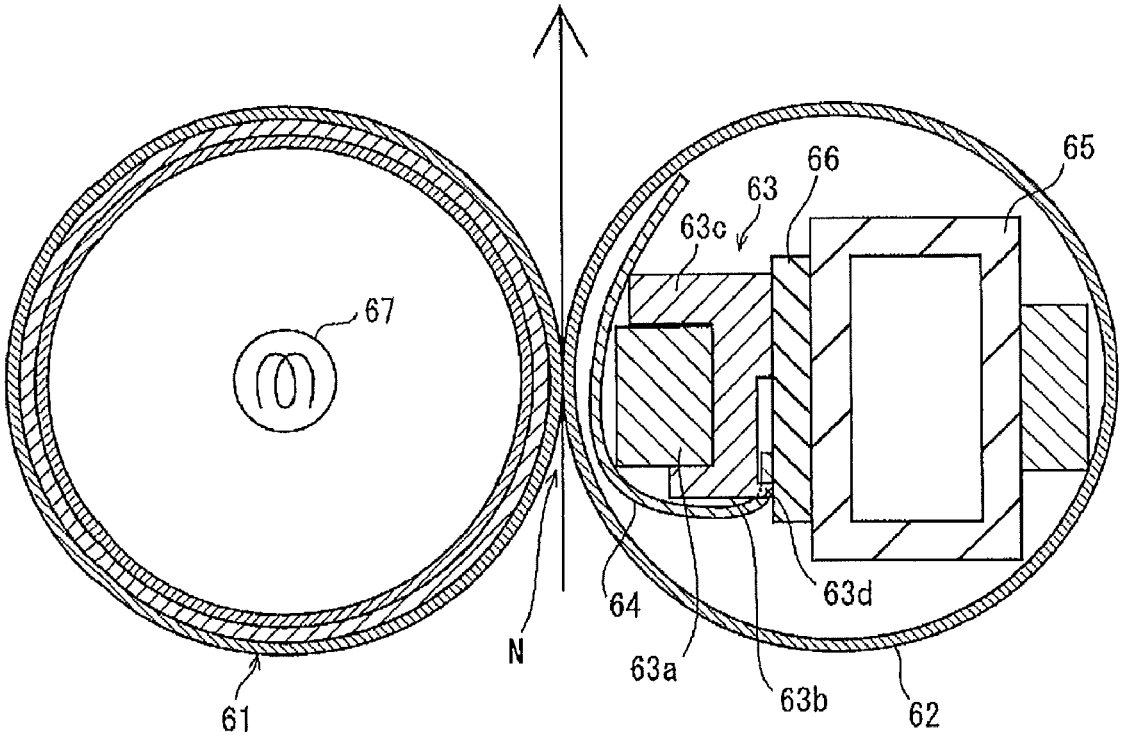
FIG. 10 Prior Art
FIG. 10 is a schematic cross-sectional view illustrating the structure of a conventional fixing device.
Figure 11:
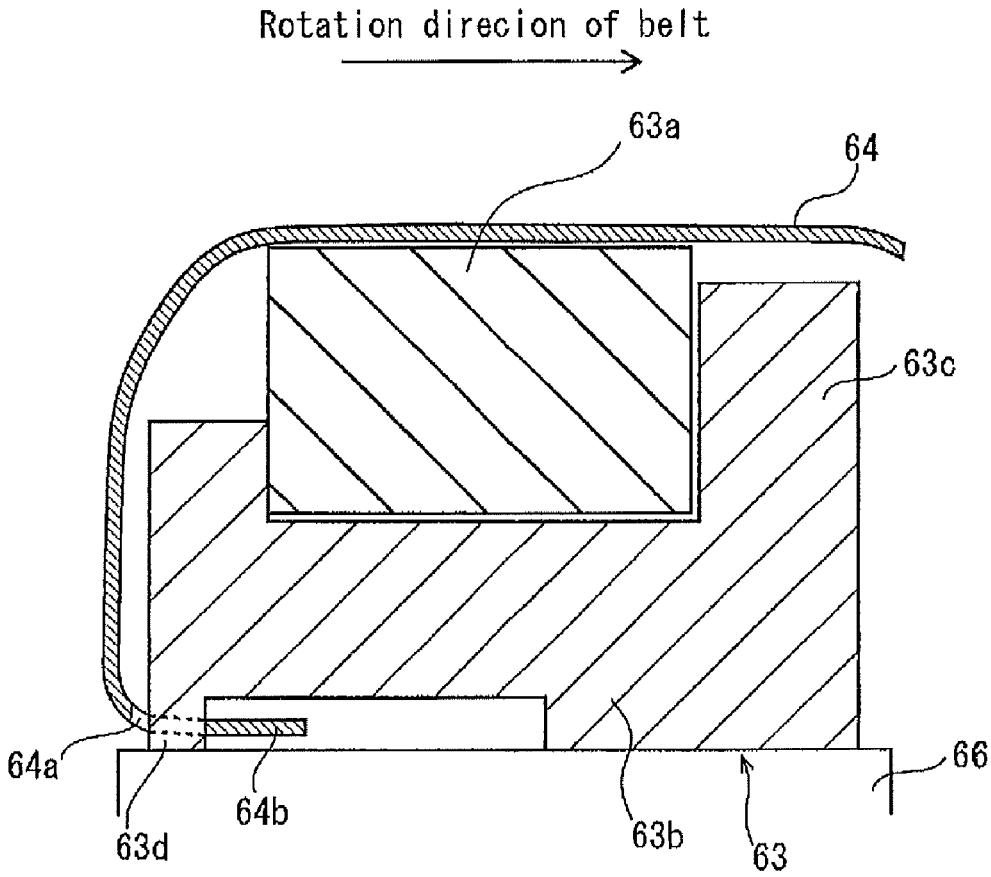
FIG. 11 Prior Art
FIG. 11 is a cross-sectional view of a pressure pad used in the conventional fixing device.
Figure 12:
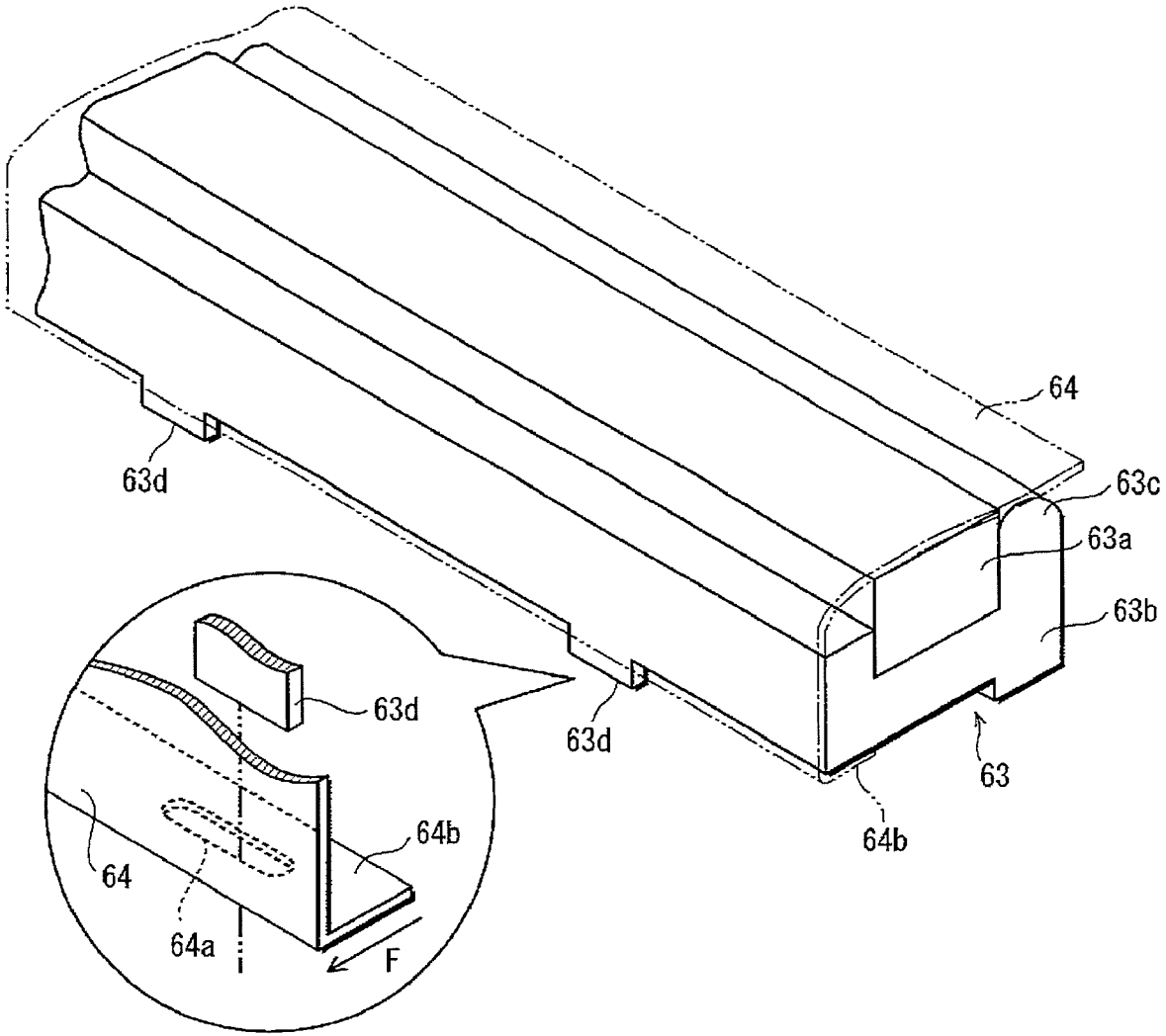
FIG. 12 Prior Art
FIG. 12 is a perspective view showing a part of the pressure pad.
Figure 13A:
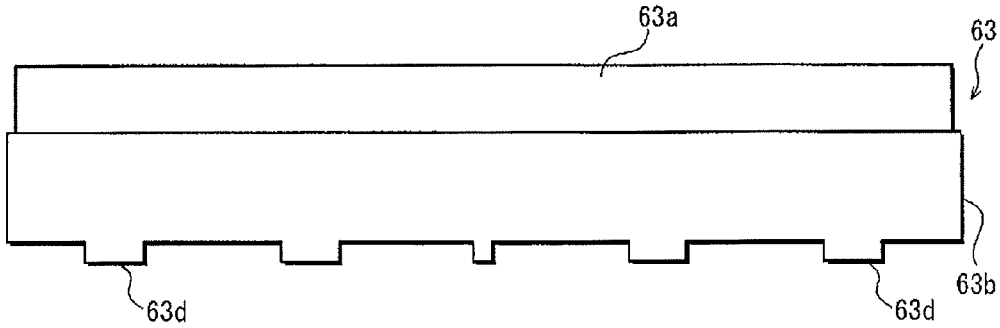
FIG. 13A Prior Art
FIG. 13A is a front view of the pressure pad.
Figure 13B:
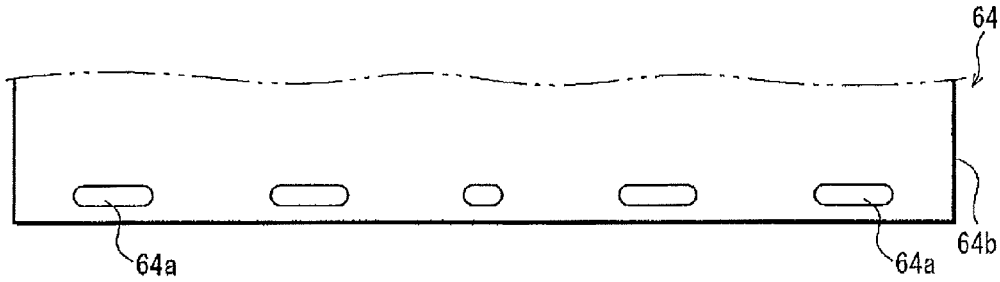
FIG. 13B Prior Art
FIG. 13B is a developed view of the upstream end of a low friction sheet with respect to the rotation direction of a fixing belt.
Figure 14:
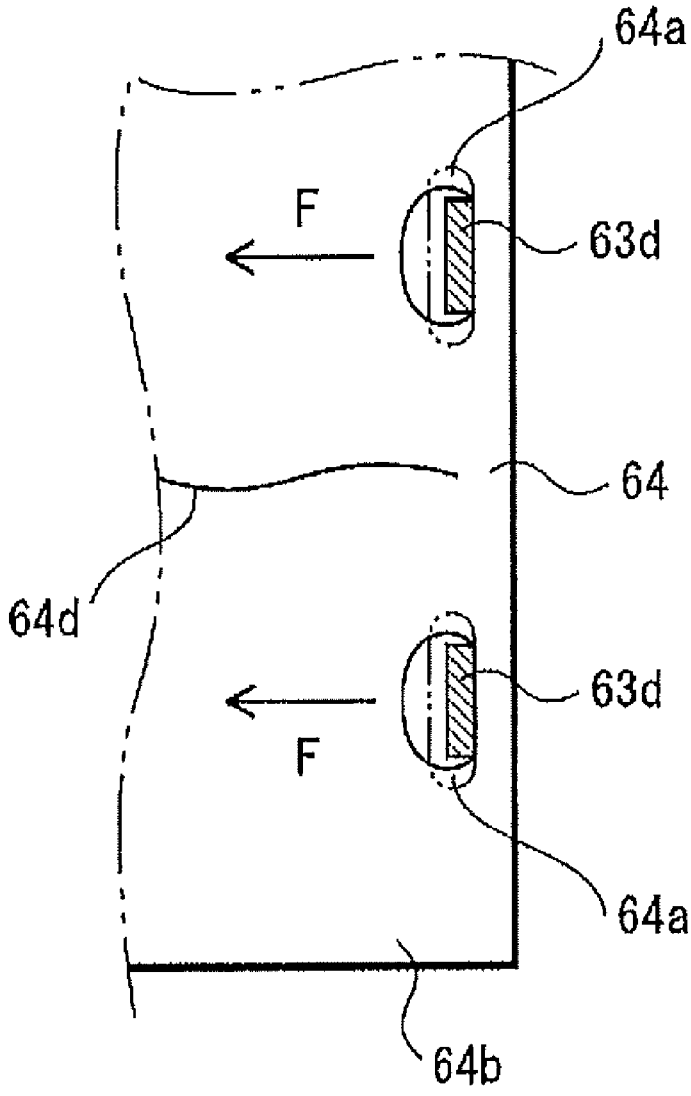
FIG. 14 Prior Art
FIG. 14 is a schematic view showing the upstream end of the low friction sheet attached to the pressure pad viewed from the bottom, which illustrates the pulling force to be applied to the upstream end while the fixing belt rotates.

Furthermore, as shown in FIG. 9, a high friction sheet 47 composed of a silicone-based rubber and the like, which have a higher friction coefficient that the low friction sheet 44, may be provided on the surface of the reinforcing part 43 that faces the main supporting structure 42*a*.

Such a structure also realizes more stably holding of the upstream end 44*a* of the low friction sheet 44, and more surely prevents the upstream end 44*a* from slipping out from between the reinforcing part 43 and the main supporting structure 42*a*. Note that the high friction sheet 47 may be provided on the main supporting structure 42*a*. Also, it may be provided on both the reinforcing part 43 and the main supporting structure 42*a*.

Modification Example of the Image Forming Apparatus

Image forming apparatuses to which the fixing device pertaining to the present invention can be applied are not limited to monochrome printers as described above as an embodiment. The fixing device is applicable to any type of monochrome and color image forming apparatuses, such as photocopying machines, fax machines, and MFPs (Multiple Function Peripherals).

The present invention is applicable to a fixing device in which a fixing nip is formed by pressing a pressure belt, which rotates while being applied a pressure from a pressing member via a low friction sheet, against a rotative fixing member such as a fixing roller, for preventing the low friction sheet from being damaged, and realizing long-term stability of the low friction sheet.

As described above, in the fixing device pertaining to the embodiment of the present invention, the upstream end of the low friction sheet between the pressure belt and the fixing member is sandwiched between the rear face of the first pressing member and the front face of the second pressing member, by pressure from the second pressing member for pressing the pressure belt against the rotative fixing member, and a reaction force applied by the rotative fixing member to the first pressing member. Here, the upstream end is upstream from the other end, with respect to the rotation direction of the pressure belt. Thus, when a pulling force is applied to the low friction sheet by the rotation of the pressure belt, the pulling force is evenly distributed across the whole area of the upstream end. Thus, the stress due to the pulling force is not intensively applied to any particular area on the upstream end. This prevents the low friction sheet from being damaged, and prevents wrinkles from being made on the low friction sheet. In this way, the structure realizes long-term stability of the low friction sheet.

It is preferable that the upstream end is no shorter than the recording sheet when measured in a width direction of the pressure belt, and a full width of the upstream end is sandwiched between the first pressing part and the second pressing part.

It is also preferable that a reinforcing part is provided on the rear face of the first pressing part, the reinforcing part being harder than the first pressing part, and the upstream end is sandwiched between the reinforcing part and the second pressing part.

It is also preferable that a presser is provided on the Second pressing part, the presser being harder than the first pressing part and pressing a downstream part of the pressure belt via the low friction sheet, the downstream part being downstream from a part of the pressure belt that is pressed by the first pressing part, with respect to a rotation direction of the pressure belt.

It is also preferable that a protrusion is provided on the reinforcing part, the protrusion protruding toward the upstream end of the low friction sheet, and the upstream end is sandwiched between the protrusion and the front face of the second pressing part.

It is also preferable that the upstream end of the low friction sheet is bonded to either one or both of the reinforcing part and the second pressing part.

It is also preferable that either one or both of the reinforcing part and the second pressing part have asperities for sandwiching the upstream end of the low friction sheet It is also preferable that a high friction member that has a higher friction coefficient than the reinforcing part and the second pressing part is provided between (i) the upstream end of the low friction sheet and (ii) either one or both of the reinforcing part and the second pressing part.

It is also preferable that the second pressing part includes a side wall that covers the lateral side of the first pressing member via the low friction sheet.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, the upstream end is sandwiched between the rear face of the first pressing part and the front face of the second pressing part, by pressure from the second pressing part and a reaction force from the first pressing part, a reinforcing part is provided on the rear face of the first pressing part, the reinforcing part being harder than the first pressing part, and the upstream end is sandwiched between the reinforcing part and the second pressing part.

2. The fixing device of claim 1, wherein a protrusion is provided on the reinforcing part, the protrusion protruding toward the upstream end of the low friction sheet, and the upstream end is sandwiched between the protrusion and the front face of the second pressing part.

3. The fixing device of claim 1, wherein the upstream end of the low friction sheet is bonded to either one or both of the reinforcing part and the second pressing part.

4. The fixing device of claim 1, wherein either one or both of the reinforcing part and the second pressing part have asperities for sandwiching the upstream end of the low friction sheet.

5. The fixing device of claim 1, wherein a high friction member that has a higher friction coefficient than the reinforcing part and the second pressing part is provided between (i) the upstream end of the low friction sheet and (ii) either one or both of the reinforcing part and the second pressing part.

6. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, the upstream end is sandwiched between the rear face of the first pressing part and the front face of the second pressing part, by pressure from the second pressing part and a reaction force from the first pressing part, and a presser is provided on the second pressing part, the presser being harder than the first pressing part and pressing a downstream part of the pressure belt via the low friction sheet, the downstream part being downstream from a part of the pressure belt that is pressed by the first pressing part, with respect to a rotation direction of the pressure belt.

7. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, the upstream end is sandwiched between the rear face of the first pressing part and the front face of the second pressing part, by pressure from the second pressing part and a reaction force from the first pressing part, and the second pressing part includes a side wall that covers the lateral side of the first pressing member via the low friction sheet.

8. An image forming apparatus having a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, the upstream end is sandwiched between the rear face of the first pressing part and the front face of the second pressing part, by pressure from the second pressing part and a reaction force from the first pressing part, a reinforcing part is provided on the rear face of the first pressing part, the reinforcing part being harder than the first pressing part, and the upstream end is sandwiched between the reinforcing part and the second pressing part.

9. The image forming apparatus of claim 8, wherein a protrusion is provided on the reinforcing part, the protrusion protruding toward the upstream end of the low friction sheet, and the upstream end is sandwiched between the protrusion and the front face of the second pressing part.

10. The image forming apparatus of claim 8, wherein the upstream end of the low friction sheet is bonded to either one or both of the reinforcing part and the second pressing part.

11. The image forming apparatus of claim 8, wherein either one or both of the reinforcing part and the second pressing part have asperities for sandwiching the upstream end of the low friction sheet.

12. The image forming apparatus of claim 8, wherein a high friction member that has a higher friction coefficient than the reinforcing part and the second pressing part is provided between (i) the upstream end of the low friction sheet and (ii) either one or both of the reinforcing part and the second pressing part.

13. An image forming apparatus having a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, the upstream end is sandwiched between the rear face of the first pressing part and the front face of the second pressing part, by pressure from the second pressing part and a reaction force from the first pressing part, and a presser is provided on the second pressing part, the presser being harder than the first pressing part and pressing a downstream part of the pressure belt via the low friction sheet, the downstream part being downstream from a part of the pressure belt that is pressed by the first pressing part, with respect to a rotation direction of the pressure belt.

14. An image forming apparatus having a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front face, which presses the low friction sheet against the pressure belt, is made of an elastic material, and (ii) a second pressing part whose front face presses against a rear face of the first pressing part, the low friction sheet extends from a portion thereof pressed by the front face of the first pressing part against the pressure belt, to an upstream end thereof, along a lateral side of the first pressing part, the upstream end being upstream from the other end of the low friction sheet with respect to a rotation direction of the pressure belt, the upstream end is sandwiched between the rear face of the first pressing part and the front face of the second pressing part, by pressure from the second pressing part and a reaction force from the first pressing part, and the second pressing part includes a side wall that covers the lateral side of the first pressing member via the low friction sheet.

* * * * *